US009623942B2

(12) United States Patent
Schiaffino et al.

(10) Patent No.: US 9,623,942 B2
(45) **Date of Patent: *Apr. 18, 2017**

(54) RETRACTABLE THRUSTER

(71) Applicant: FINCANTIERI S.p.A., Trieste (IT)

(72) Inventors: Giacomo Schiaffino, Trieste (IT); Alessandro Calcagno, Trieste (IT); Stefano Bucci, Trieste (IT); Giovanni Magnano, Trieste (IT)

(73) Assignee: FINCANTIERI S.p.A., Trieste (IT)

( * ) Notice: Subject to any disclaimer, the term of this patent is extended or adjusted under 35 U.S.C. 154(b) by 0 days.

This patent is subject to a terminal disclaimer.

(21) Appl. No.: 14/787,195

(22) PCT Filed: Mar. 19, 2014

(86) PCT No.: PCT/IB2014/059971

§ 371 (c)(1),
(2) Date: Oct. 26, 2015

(87) PCT Pub. No.: WO2014/174385

PCT Pub. Date: Oct. 30, 2014

(65) Prior Publication Data

US 2016/0101839 A1 Apr. 14, 2016

(30) Foreign Application Priority Data

Apr. 26, 2013 (IT) ..... MI2013A0694

(51) Int. Cl.
*B63H 5/125* (2006.01)
*B63B 17/00* (2006.01)
(Continued)

(52) U.S. Cl.
CPC ..... *B63H 5/1252* (2013.01); *B63B 17/0018* (2013.01); *B63H 5/125* (2013.01);
(Continued)

(58) Field of Classification Search
CPC ..... B63H 5/125; B63H 5/1252; B63H 5/14; B63H 5/15; B63H 2005/125;
(Continued)

(56) References Cited

U.S. PATENT DOCUMENTS 2,885,990 A 5/1959 Hawthorne
2,987,027 A 6/1961 Wanzer
(Continued)

FOREIGN PATENT DOCUMENTS

EP 0 591 969 A1 4/1994
KR 2012-0017025 A 2/2012
WO WO 2010/136012 A1 12/2010

OTHER PUBLICATIONS

International Search Report for corresponding International Patent Application No. PCT/IB2014/059971 mailed Jul. 10, 2014.

*Primary Examiner* — Daniel V Venne
(74) *Attorney, Agent, or Firm* — Merchant & Gould P.C.

(57) ABSTRACT

A propulsion assembly of a ship or floating platform includes a housing within a hull or platform. The housing is watertight except for an opening external to the hull. A stationary motor is arranged in the hull external to the housing. A thruster is external to the hull to generate thrust on the ship or floating platform. A telescopic driving shaft passes sealingly through a housing wall to connect the motor and the thruster and to transmit movement from the motor to the thruster. The thruster retracts within the housing through the opening. A separate submersible movable hatch is disconnectable from the thruster and the housing and passes externally to the hull, and seals the opening to form a watertight closed chamber. A fluid evacuation device evacuates fluid within the closed chamber so the thruster, when retracted in the housing and closed by the hatch, forms the closed chamber.

10 Claims, 12 Drawing Sheets

(51) Int. Cl.
*B63H 5/14* (2006.01)
*B63H 21/36* (2006.01)
*B63H 25/42* (2006.01)

(52) U.S. Cl.
CPC ..... *B63H 5/14* (2013.01); *B63H 21/36* (2013.01); *B63H 2025/425* (2013.01)

(58) Field of Classification Search
CPC .... B63H 2005/1254; B63H 2005/1256; B63H 2005/1258; B63H 21/36
USPC ..... 440/53, 61 R, 61 S, 63, 66, 67, 68, 69, 440/71, 76, 79
See application file for complete search history.

(56) References Cited

U.S. PATENT DOCUMENTS 3,030,910 A 4/1962 Alsager
3,483,843 A 12/1969 Hawthorne
3,550,547 A * 12/1970 Pleuger ..... B63H 5/14 114/151
4,075,971 A * 2/1978 Reginensi ..... B63H 5/125 440/54
4,274,827 A 6/1981 Catsburg
4,573,929 A * 3/1986 Savikurki ..... B63H 5/125 192/69.91
4,580,517 A 4/1986 Lundberg
5,397,255 A 3/1995 Heer
5,435,762 A * 7/1995 Reuter ..... B63H 5/125 440/54
5,522,335 A * 6/1996 Veronesi ..... B63H 5/125 114/151
6,056,610 A * 5/2000 Fontanille ..... B63H 5/125 440/54
6,375,524 B1 4/2002 Commandeur et al.
6,439,936 B1 8/2002 Dreith et al.
6,458,004 B2 * 10/2002 Van Breems ..... B63H 5/1252 440/54
7,641,526 B1 1/2010 Bekker
9,266,595 B2 * 2/2016 Van Der Kam ..... B63H 5/125
9,340,268 B2 * 5/2016 Choi ..... B63H 5/125
2001/0029133 A1 10/2001 Breems
2012/0058694 A1 3/2012 Krautkramer

* cited by examiner

RETRACTABLE THRUSTER

This application is a National Stage Application of PCT/IB2014/059971, filed 19 Mar. 2014 which claims benefit of Serial No. MI2013A000694, filed 26 Apr. 2013 in Italy, and which applications are incorporated herein by reference. To the extent appropriate, a claim of priority is made to each of the above disclosed applications.

FIELD OF THE INVENTION

The present invention relates to a retractable thruster assembly of a ship or a floating platform.

Particularly, the present invention relates to a retractable thruster assembly suitable to be maintained while the ship or the floating platform is at anchor, as well as in the case of a ship or platform that is floating.

BACKGROUND OF THE ART

Retractable thrusters or azimuthal retractable thrusters have been long known. The azimuthal thrusters are marine thrusters rotatable about a vertical axis (hence the name of azimuthal), thereby allowing the orientation of the propeller in any horizontal directions, making the presence of a rudder redundant. These azimuthal thrusters allow a considerable maneuverability of ships, but also of floating platforms, which require to accurately maintain a position when out at sea.

Such solutions are known, for example, from U.S. Pat. No. 6,375,524, U.S. Pat. No. 6,439,936, US 2001/029133, EP 0 591 969, KR 2012/0017025, U.S. Pat. No. 6,375,524, WO 2010/136012.

Retractable thrusters are also known from the state of the art, which are retracted into housings that are suitable to the maintenance thereof.

For example, from the document U.S. Pat. No. 5,397,255 by Schottel Werft Joseph Becker GmbH. & Co., KG, a propulsion unit for a ship is known, having a thruster with a propeller that may be retracted into a cylindrical case and closed by a cover plate that is secured to the thruster, so that water present in the cylindrical case may be pumped out, once it is closed, with the purpose of ensuring the access for the thruster inspection and maintenance.

Particularly, this known solution provides for a propeller projecting under the bottom of the ship and retractable in a case arranged within the bottom, which is locally flat. Said case is surrounded at the lower edge thereof by an annular groove comprising a gasket to seal said case when the cover plate firmly at the thruster is retracted and contacts the bottom. Said plate is firmly secured in a removable manner to the thruster so that the propeller and the plate may be lifted and lowered vertically together.

This known solution, while allowing the maintenance of the thruster when it is retracted within of the hull, is particularly bulky and heavy in all the steps of use thereof. Particularly, the closing plate that is firmly secured to the thruster adds additional weight, as well as a drag of the ship for the entire time of normal use of the thruster in the extended position.

Of course, the presence of this closing plate secured to the thruster makes this solution unsuitable for thrusters inclinable with respect to the vertical axis, such as, for example the solutions described in the documents U.S. Pat. No. 7,641,526 and U.S. Pat. No. 4,580,517.

Furthermore, it has to be considered that these known retractable thrusters, moreover in the case of applications on floating platforms, remain in the extended and operative position most of the time of use of the platform or ship. Therefore, the overall dimensions given by the closing plate and the ship drag thereof are a particularly felt problem.

Furthermore, in these applications, the substantially constant exposure of the closing plate to the substances that are present externally to the hull lead to a degradation of the plate portions that are suitable to the coupling with the hull, sometimes compromising the perfect coupling thereof to the hull. For example, suppose how the effect of building-up incrustations may make the closure of the plate in contact with the bottom problematic and the risks following any water leakage into the cylindrical case into which the thruster is retracted for the maintenance thereof.

Furthermore, this known solution of retractable thruster forces to the assembling of the thruster itself and the motor associated thereto on a scaffolding that allows a vertical movement suitable to the withdrawal and the retraction of the thruster into the hull. Therefore, this solution has necessarily to provide for the use of a, bulky interspace arranged vertically in the hull, which allows, in any time during the navigation, retracting the support scaffolding of the thruster motor within the hull itself, resulting in a considerable waste of volume within the hull, which volume the ship owner would like to be intended for other paying uses.

This solution necessarily forces to a specific designing of the retractable thruster provided with the special closing plate thereof. Supposing a ship or a floating platform of medium or large dimensions, it is realized that, in order properly maneuver, a plurality of retractable thrusters will be present, each being provided with the closing plate thereof and the scaffolding thereof for handling the thruster into the cylindrical case. The presence of this plurality of retractable thrusters, implemented according this known solution, is not only particularly heavy, but moreover bulky and arranged in different areas of the hull, thus forcing to implement several vertical interspaces, which may sometimes reach the entire height of the same hull, segmenting the internal volume of the ship, thus making the use thereof still more complex.

Other solutions are known, for example, from U.S. Pat. No. 2,987,027, U.S. Pat. No. 3,483,843, U.S. Pat. No. 2,885,990, U.S. Pat. No. 3,030,910. However, no one of these documents proposes a solution to the above-mentioned drawbacks and needs. Particularly, none of these solutions proposes a retractable thruster assembly that is as light-weighted as possible, not very bulky, and avoids any ship drag as much as possible, while ensuring at least the routine maintenance of the thruster when it is retracted within the hull.

Therefore, a particularly felt problem is to propose a thruster assembly for a ship or a floating platform, that allows the maintenance of the thruster itself when the ship or platform is floating, minimizing the weight and the overall dimensions of the structures interlocked to the retractable thruster.

SUMMARY OF THE INVENTION

Therefore, the object of the present invention is to devise and propose a retractable thruster assembly that allows solving the above-mentioned drawbacks.

A solution to these and other problems is given by a thruster assembly of a ship or a floating platform.

In accordance with a general embodiment of the present invention, a propulsion assembly of a ship, or a floating platform, comprises a hull insert forming a housing, or propeller case, arranged within a hull of said ship or platform. In particular, this housing is a watertight housing, at least with respect to the hull, in all the walls thereof, except for an opening that opens externally to the hull of the ship or platform.

A motor is provided for within the hull, for example, but not necessarily, an electric motor, which is arranged externally to said housing and secured in a stationary manner to the hull, or, in other terms, arranged connected with the hull so as to remain in a stationary position thereto.

Said assembly further comprises a thruster, for example, but not necessarily, a propeller foot. This thruster is a thruster that is extractable and retractable within the hull, and it is suitable to be arranged externally to said hull to generate a propulsion thrust on said ship or platform.

Advantageously, said assembly further comprises a telescopic driving shaft. Said telescopic driving shaft is arranged passing through and forming a seal with one of the walls of said housing to operatively connect said motor secured to the hull and, for example, but not necessarily, in an detachable manner, said thruster.

Advantageously, said thruster is retractable within said housing, passing through said opening so as not to project externally to the hull when it is in the retracted position.

With further advantage, said assembly provides for a submersible movablemovable hatch made in a separate piece and completely disconnected from said thruster and said housing.

Said submersible movable hatch is suitable to associate externally to said housing, passing externally to said hull, for sealing and closing said opening of said housing, closing the housing to form a watertight closed chamber with respect to the outside of the hull.

Said assembly further provides for a fluid evacuation device for evacuating a fluid, for example, but not necessarily, sea water, which is present within said closed chamber, so as to arrange said thruster at least partially in air, when completely retracted in said housing and closed by said submersible movable hatch in a closed chamber.

By virtue of the provision of a watertight closed chamber, the present solution allows carrying out the maintenance of the propeller foot when the ship or platform is floating. By virtue of the possibility of evacuating the fluid, for example, sea water, it will be possible to carry out minor maintenance operations, for example, replacing the seals of the propeller foot, when the latter is arranged within the hull in said housing when the ship or platform is floating, maybe far from the shore or another dock.

The provision of a submersible movable hatch that is completely detachable from the thruster allows minimizing the assembly weight, hence of the structures interlocked to the retractable thruster, and it allows implementing a hull closing system to create an area, a watertight closed chamber, which is suitable to the maintenance and inspection of the thruster, which solution at the same time allows not to affect the thruster performance when this is extended to the exterior of the hull.

By virtue of the provision of a telescopic driving shaft, it is possible to implement a not very bulky assembly, which leaves the motor in a stationary position with respect to the hull, avoiding taking a considerable volume within the hull itself, which volume may be dedicated to other uses. Furthermore, by virtue of this solution, it is possible to avoid providing scaffoldings for the movement of motor components, considerably simplifying the construction of the assembly and reducing the overall dimensions while facilitating maintenance.

By virtue of the proposed solution, it is possible to increase safety during the maintenance steps, avoiding the build-up of dirt or incrustations in bulkheads or hatches suitable for a watertight closure, and in particular avoiding undesired infiltrations.

Advantageously, the provision of a submersible movable hatch in a separate piece and completely disconnected from the thruster and the housing allows, by virtue of scheduled maintenance operations, arranging only one closing hatch for multiple housings, so as to proceed with the maintenance of multiple retractable thrusters that are present on the same ship or platform through only one hatch.

Furthermore, the proposed solution is particularly advantageous, since it allows using the same handling means of the submersible movable hatch, also optionally to couple, hang and optionally lower the thruster, further increasing the constructive simplicity of the assembly, hence the safety of use.

BRIEF DESCRIPTION OF THE DRAWINGS

Further characteristics and advantages of the assembly according to the invention will be apparent from the description set forth below of preferred embodiment examples thereof, given by way of illustrative, non-limiting example, with reference to the appended figures, in which.

DETAILED DESCRIPTION OF THE PREFERRED EMBODIMENT(S)

Figure 1:
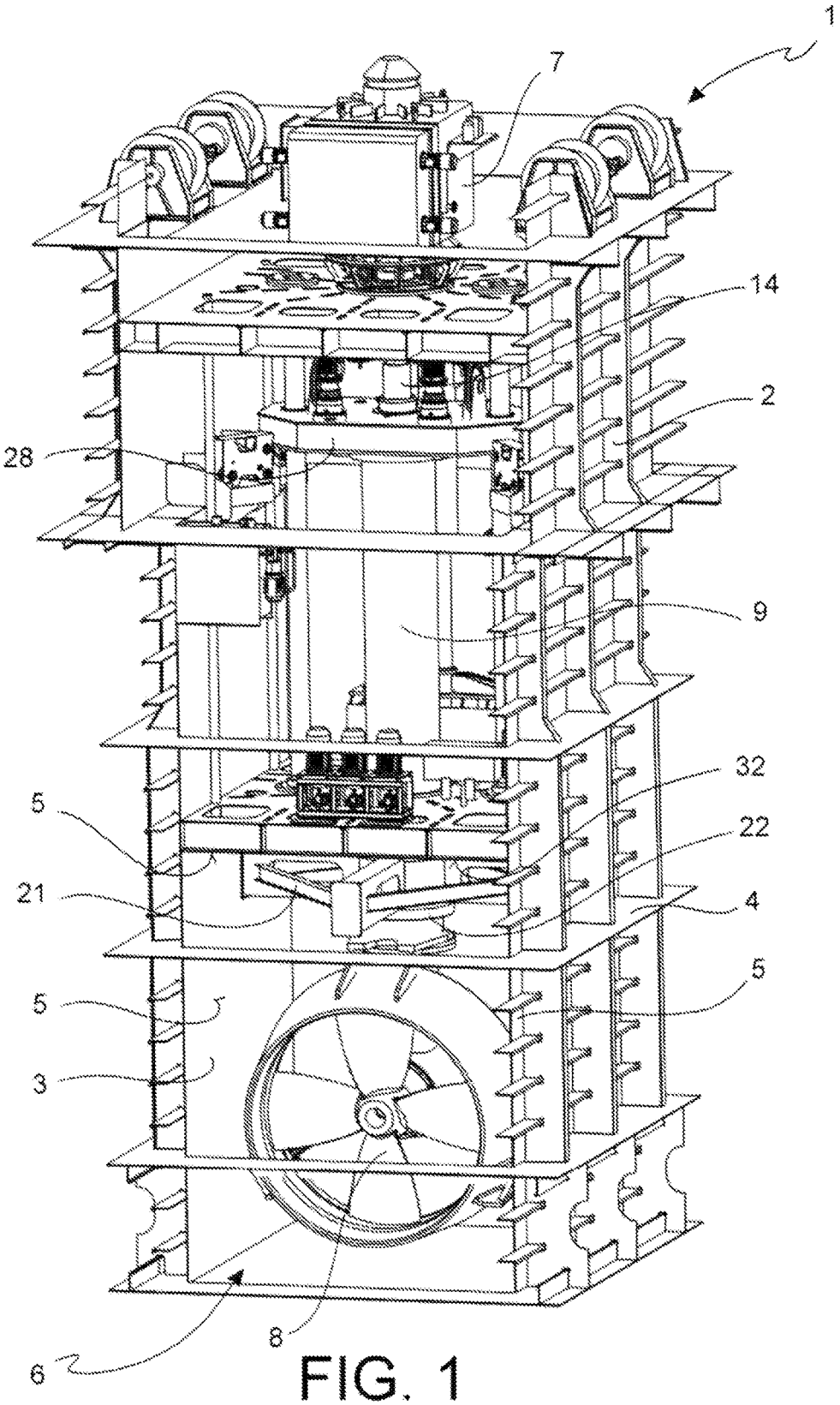
FIG. 1 shows an axonometric and partially sectioned view, so as to show the contents thereof, a retractable thruster assembly for ships or floating platforms.
Figure 2:
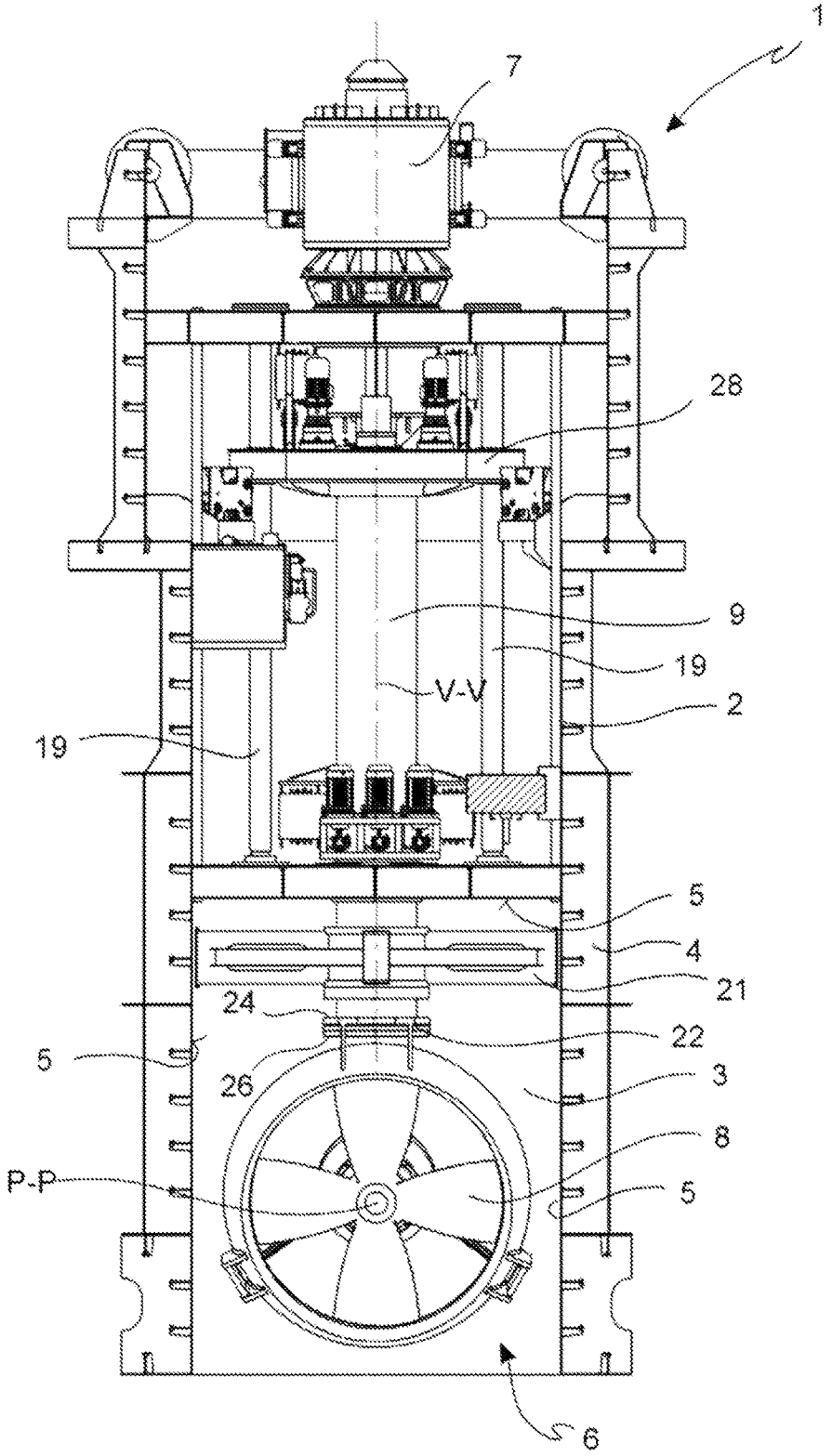
FIG. 2 illustrates a side, partially sectioned view, the assembly of FIG. 1.
Figure 3A:
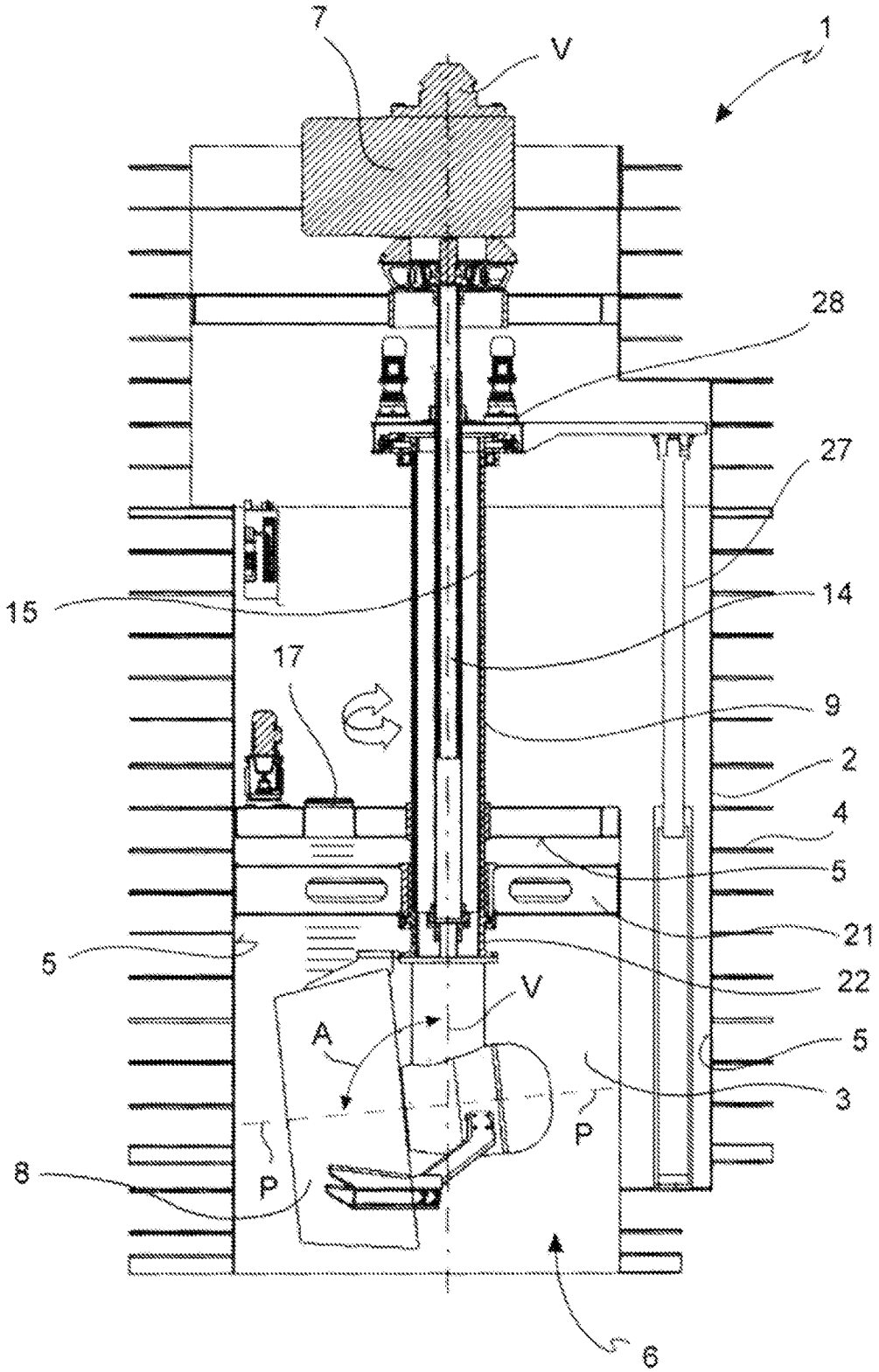
FIG. 3A shows in a front, partially sectioned view, the assembly of FIG. 1.
Figure 3B:
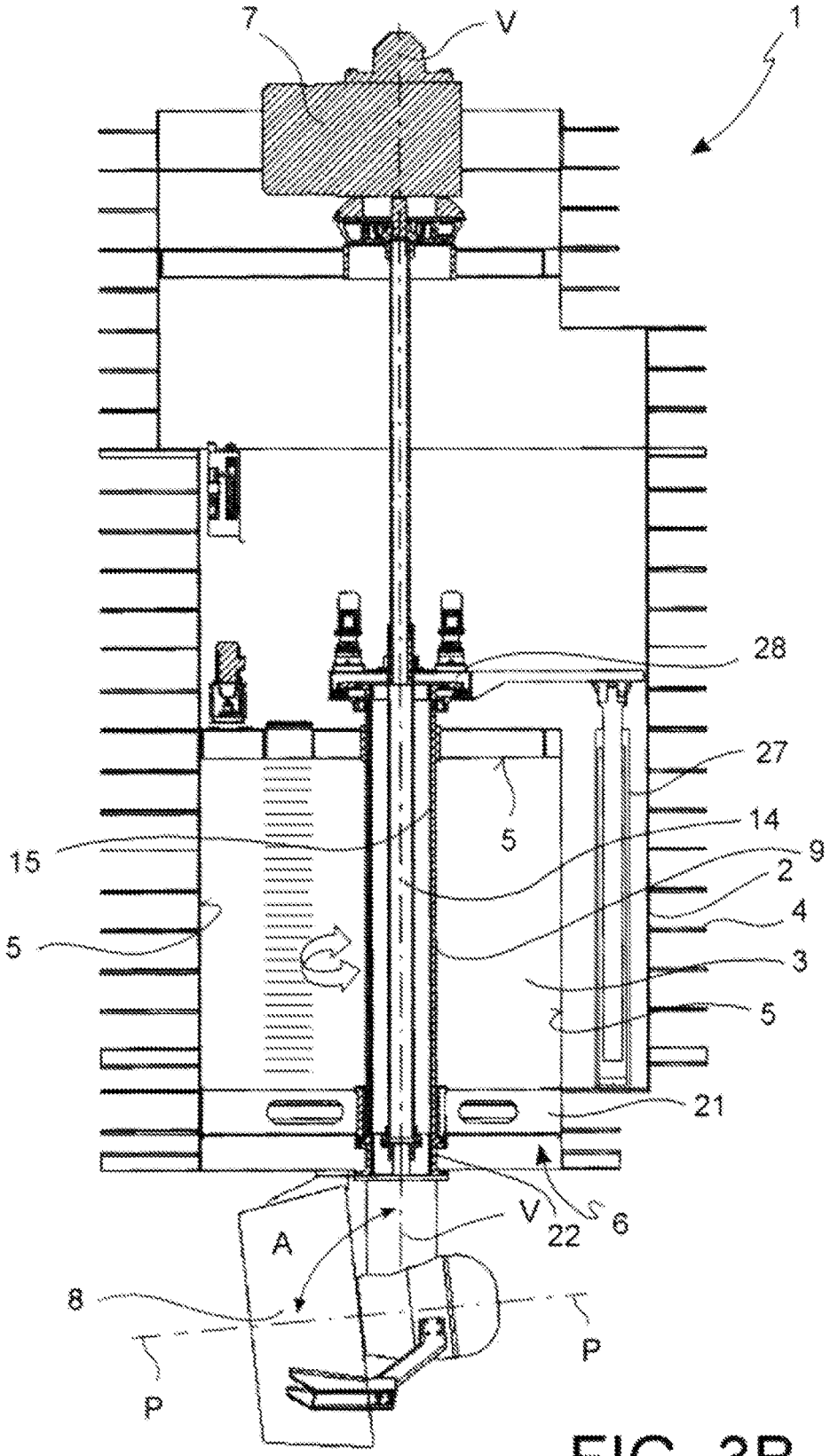
FIG. 3B shows a front, partially sectioned view, the assembly of FIG. 1, but with the thruster in the extendedextended position and the telescopic driving shaft in an elongated position.
Figure 4A:
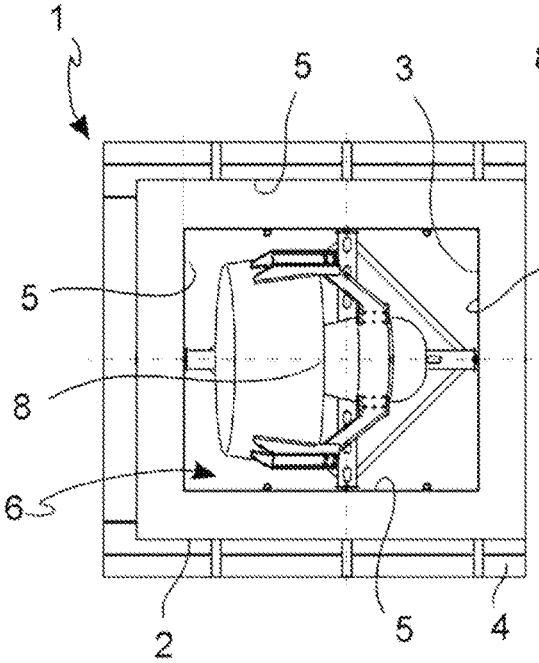
FIGS. 4A and 4B represent a bottom view and a sectioned view, respectively, of the section immediately above of the thruster as seen towards the thruster of the assembly of FIG. 1.
Figure 4B:
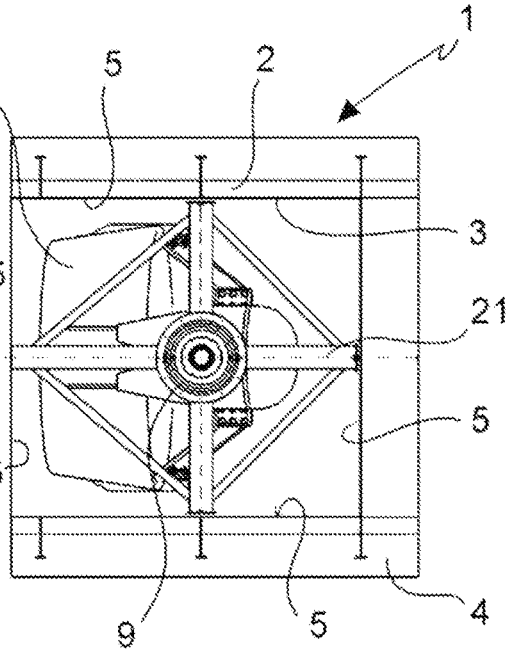
Figure 5:
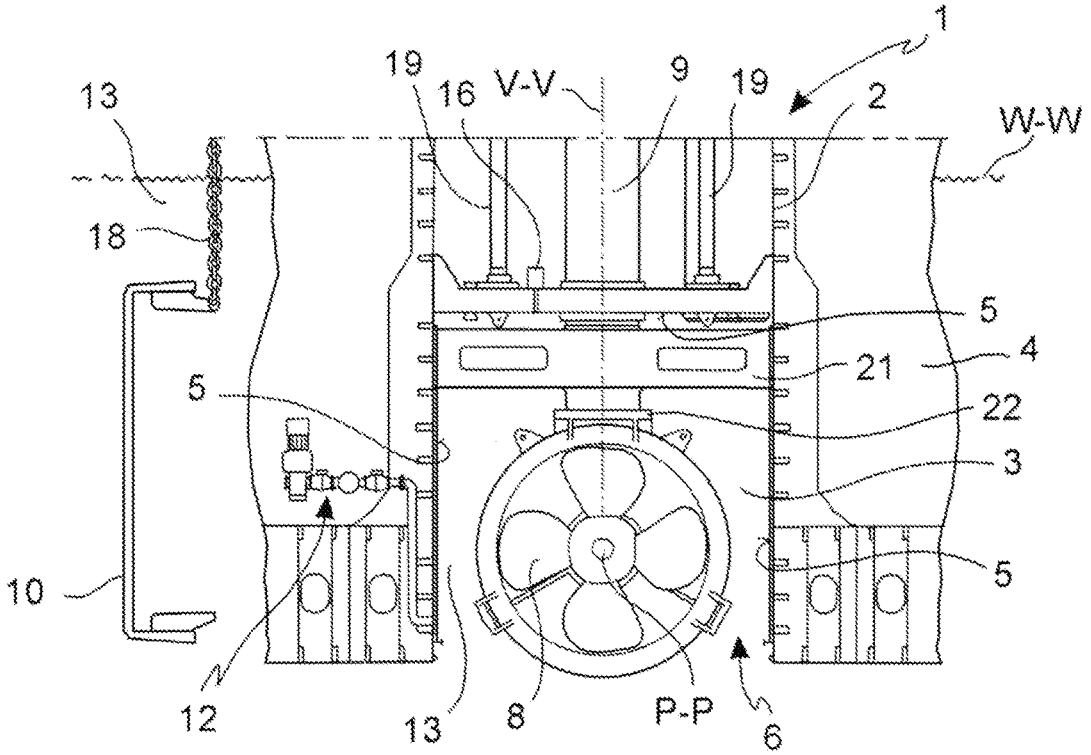
FIG. 5 shows the side, partially sectioned view of a retractable thruster assembly in a first maintenance step, in which it is lowered to the sea laterally to the hull when the submersible movable hatch closes the housing for the thruster.
Figure 6:
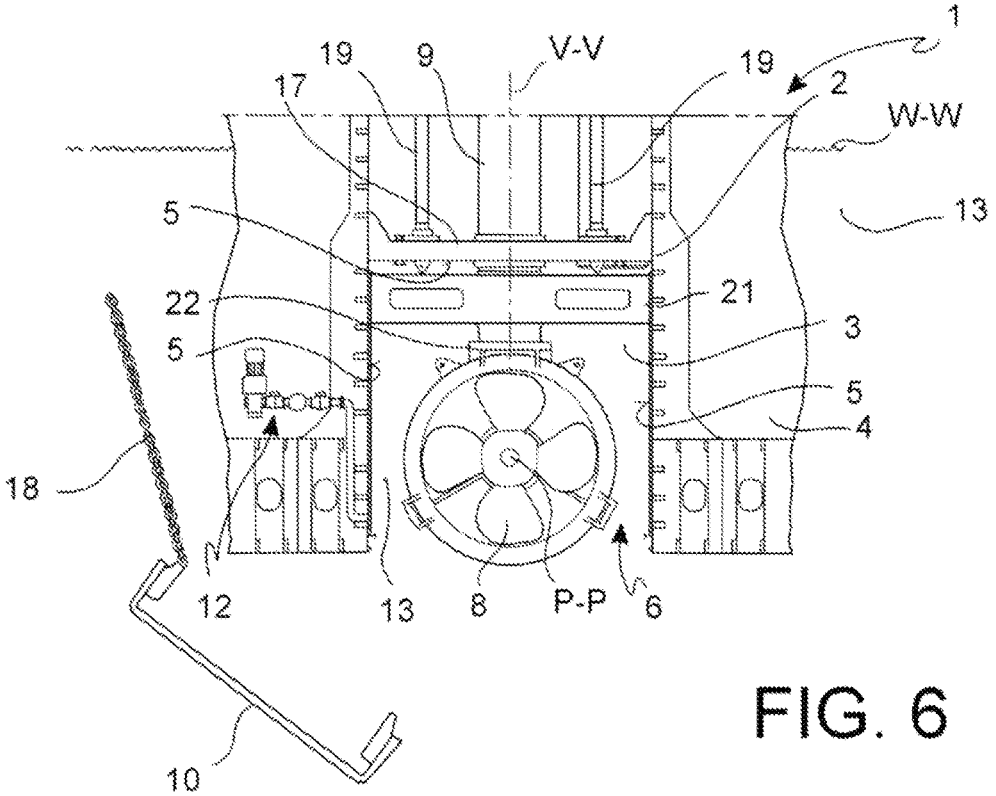
FIG. 6 shows the side, partially sectioned view of the retractable thruster assembly of FIG. 5 in a second maintenance step, in which the submersible movable hatch is brought near to the housing opening.
Figure 7:
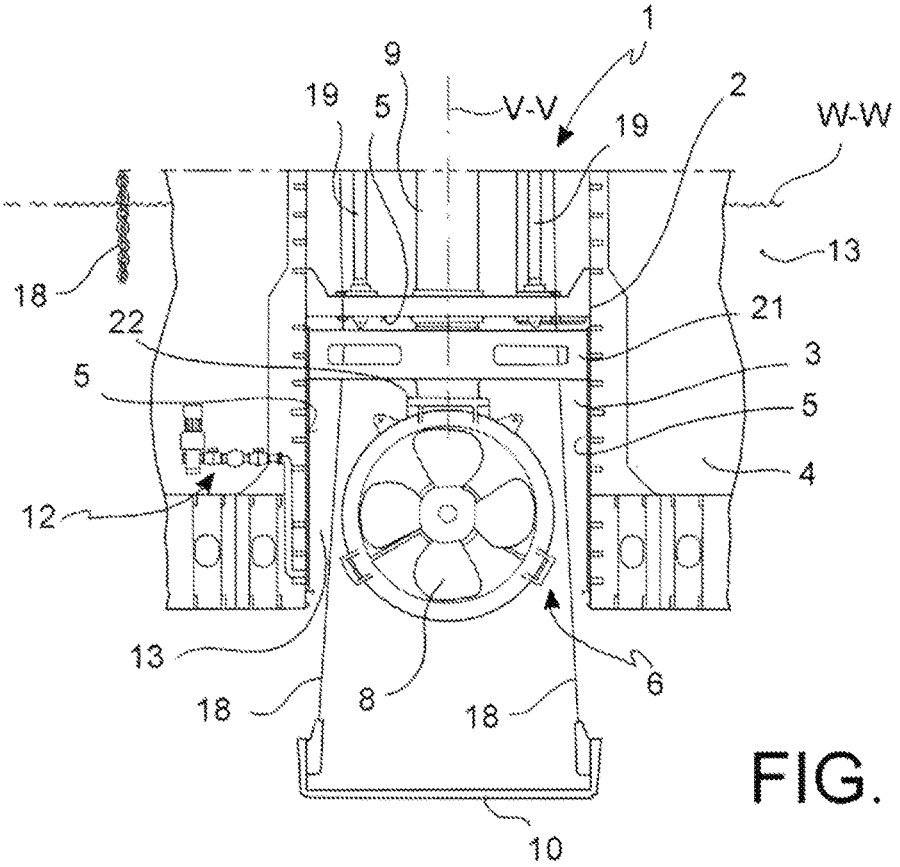
FIG. 7 shows the side, partially sectioned view of the retractable thruster assembly of FIG. 5 in a third maintenance step, in which the submersible movable hatch is hung from hanging cables passing through the housing.
Figure 8:
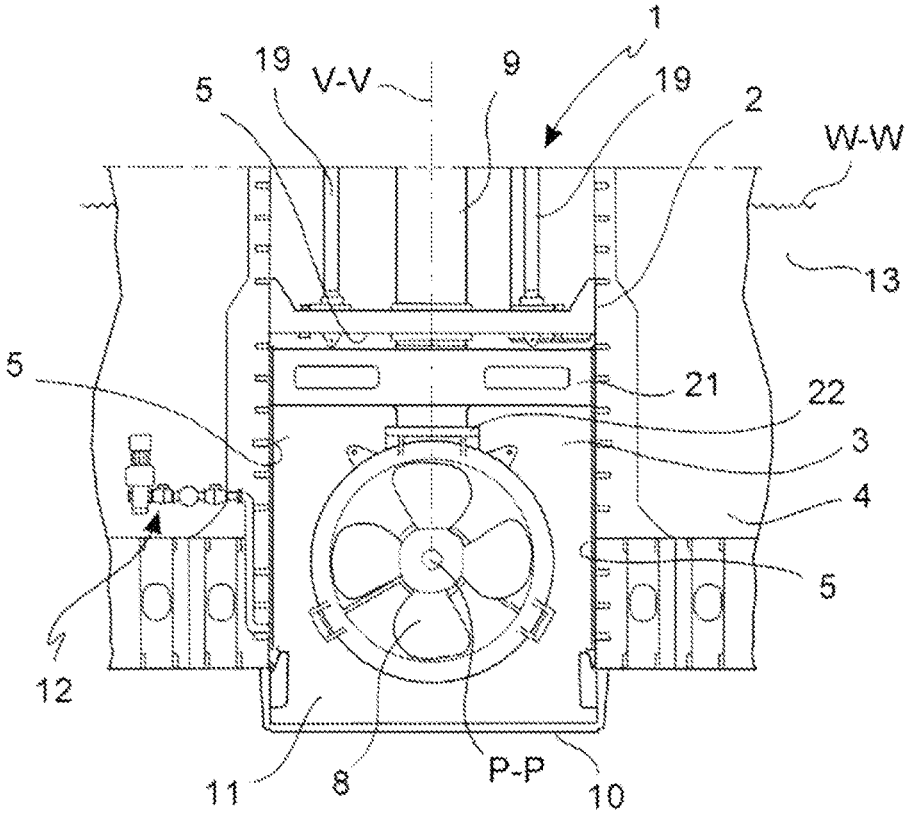
FIG. 8 shows the side, partially sectioned view of the retractable thruster assembly of FIG. 5 in a fourth maintenance step, in which the submersible movable hatch is coupled to the opening.
Figure 9:
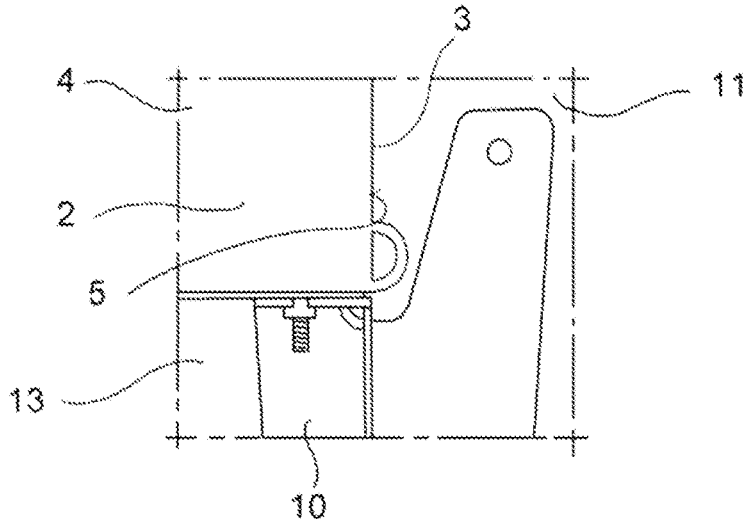
FIG. 9 shows a sectioned view a detail of the coupling between the submersible movable hatch and a coupling edge of the hull insert defining the opening.
Figure 10A:
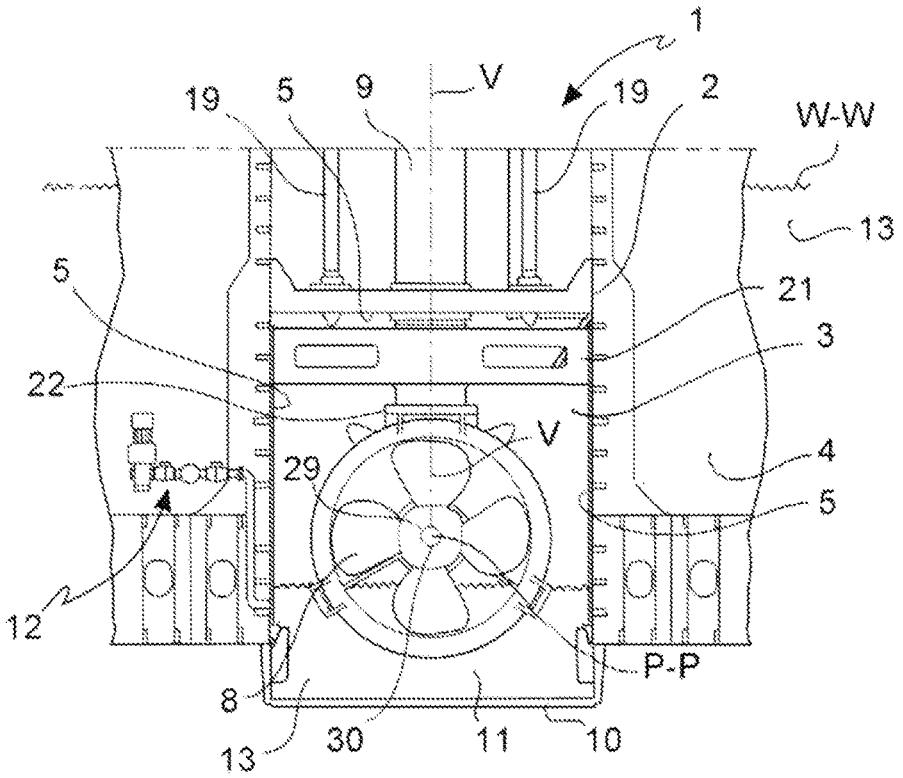
FIG. 10 shows the side, partially sectioned view of the retractable thruster assembly of FIG. 5 in a fifth maintenance step, in which the closed chamber that is formed by coupling the submersible movable hatch to the housing opening is at least partially emptied of water by putting in air at least the part of the thruster that is ready for the maintenance in situ or for other maintenance operations.
Figure 10B:
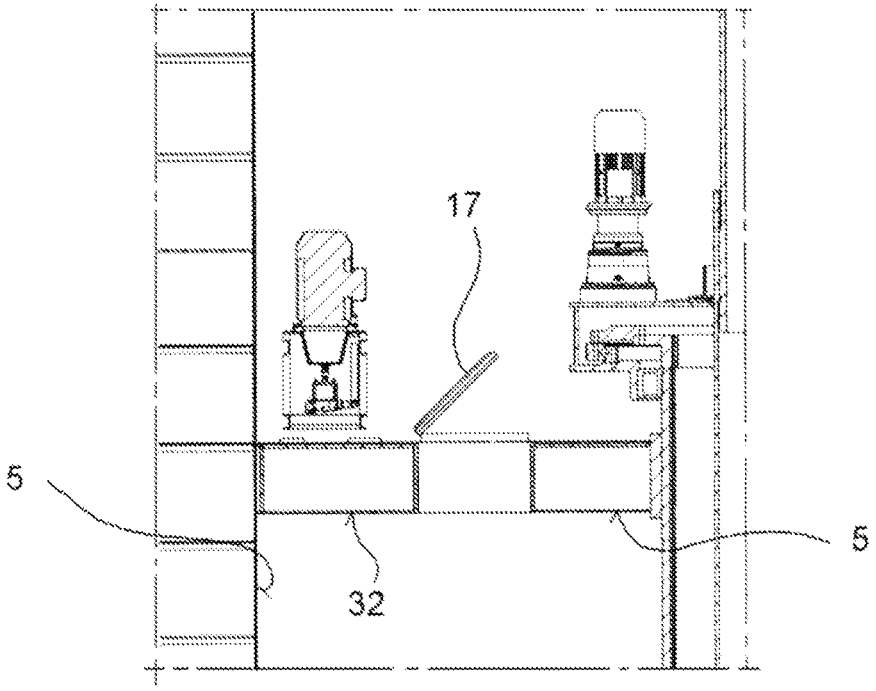
Figure 11:
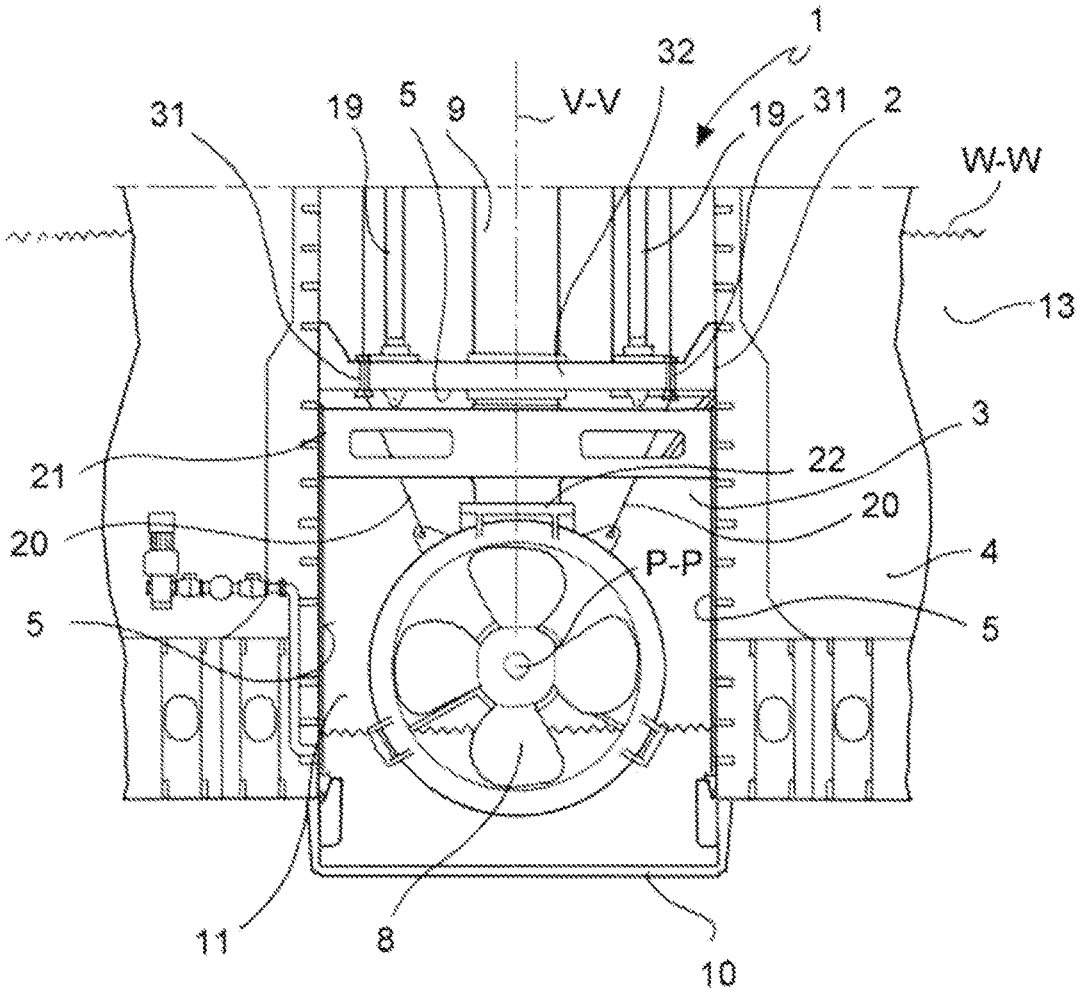
FIG. 11 shows the side, partially sectioned view of the retractable thruster assembly of FIG. 5 in a sixth maintenance step, in which the thruster is supported hanging from hanging cables passing through a housing wall.
Figure 12:
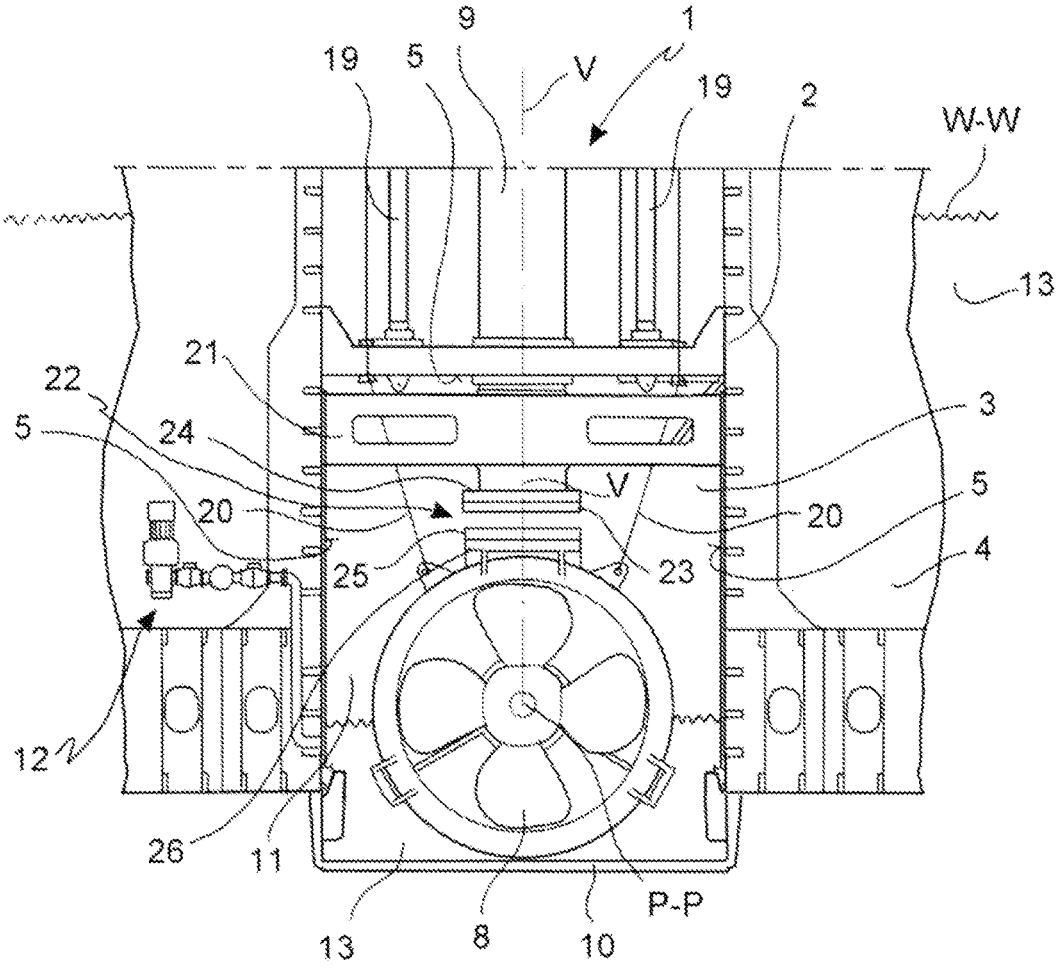
FIG. 12 shows the side, partially sectioned view of the retractable thruster assembly of FIG. 5 in a seventh maintenance step, in which the thruster supported hanging from hanging cables is uncoupled from the telescopic driving shaft and sealing cuffs are fitted on the free coupling end between shaft and thruster.
Figure 13:
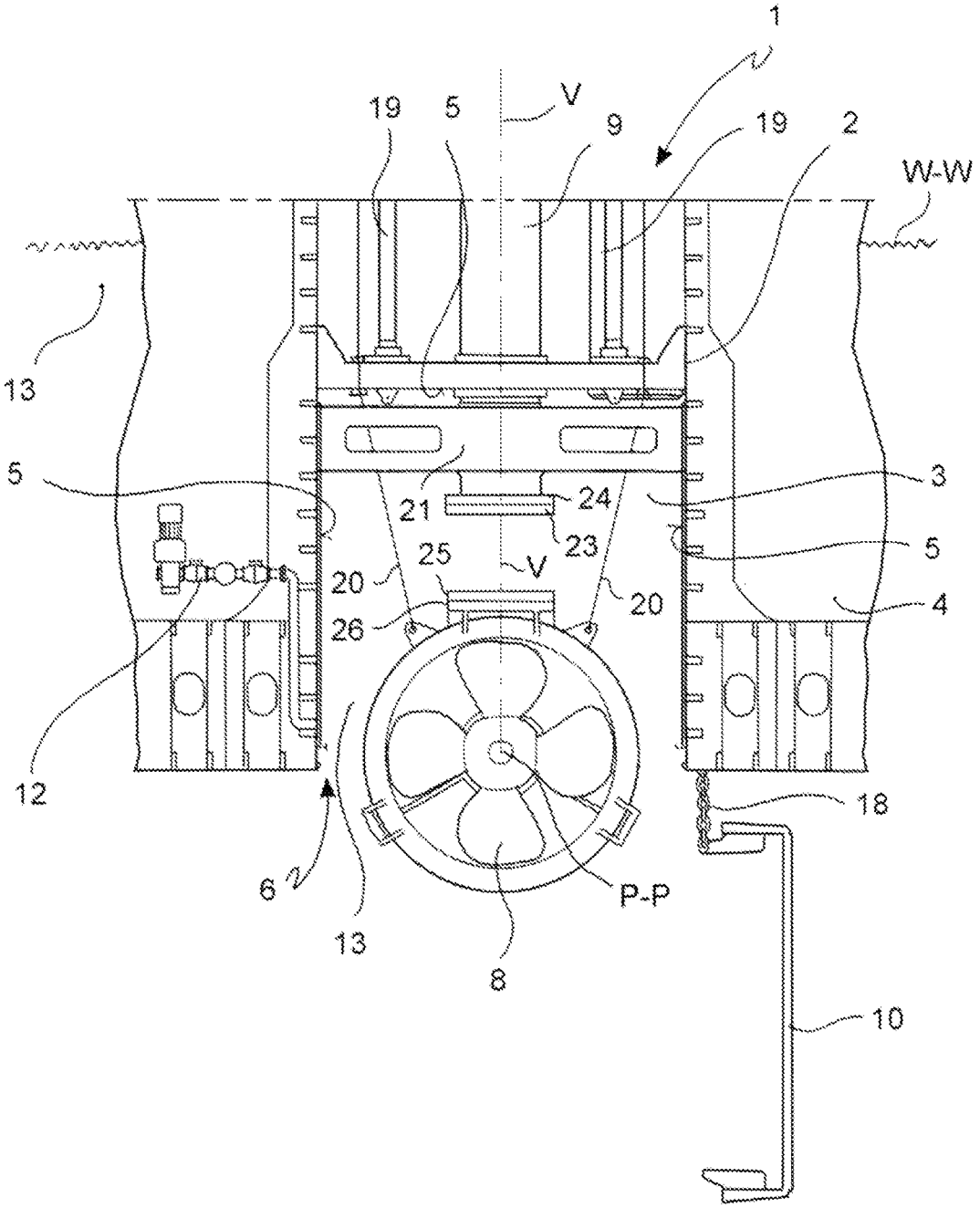
FIG. 13 shows the side, partially sectioned view of the retractable thruster assembly of FIG. 5 in an eighth maintenance step, in which the closed chamber is filled with water again, the submersible movable hatch is uncoupled from the edge of the opening, which is open, and the thruster supported hanging from hanging cables is gradually lowered outside the hull.
Figure 14:
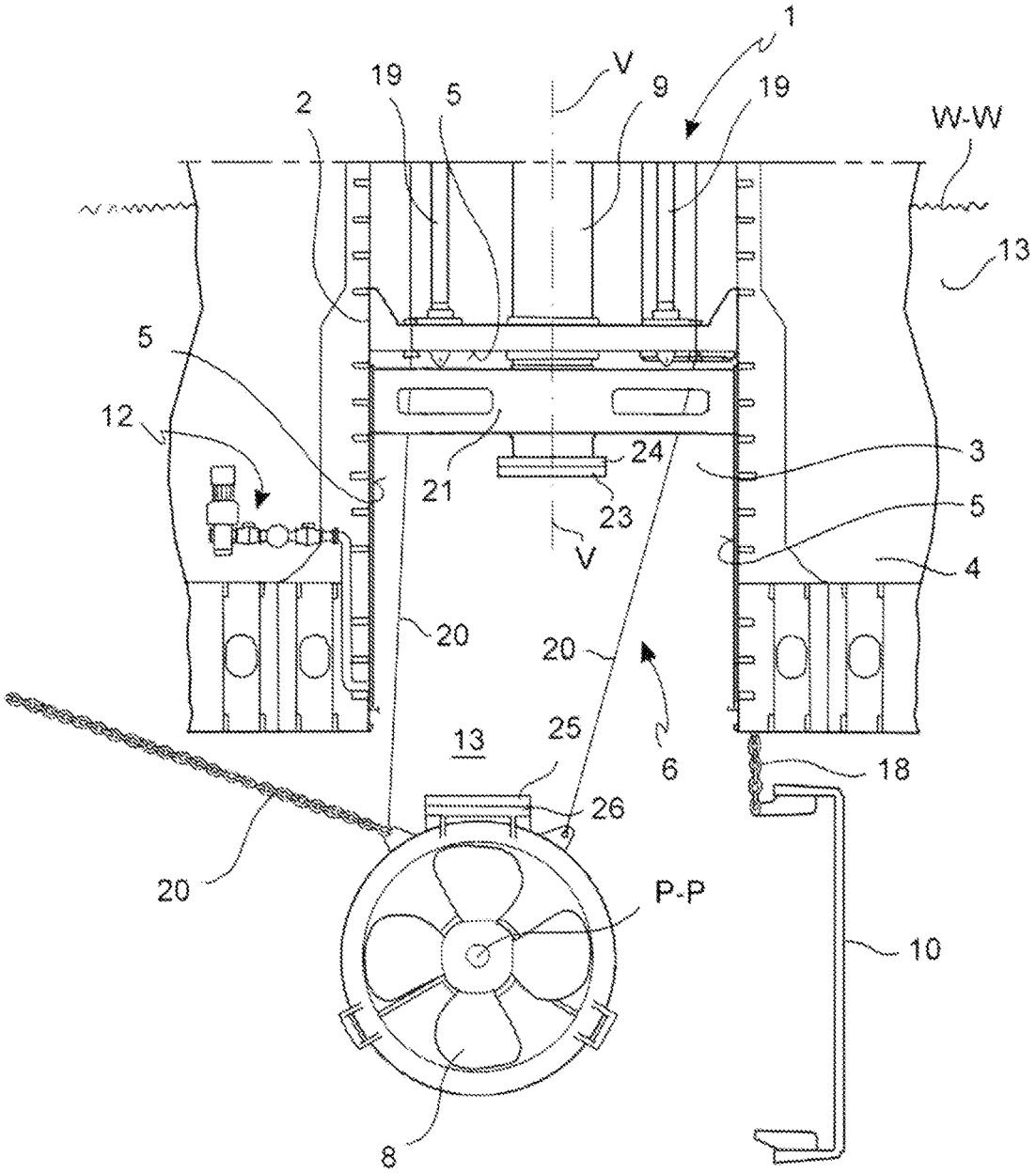
FIG. 14 shows the side, partially sectioned view of the retractable thruster assembly of FIG. 5 in a ninth maintenance step, in which the thruster supported hanging from hanging cables is supported by chains that are external to the hull and gradually lifted high outside the hull.

With reference to the above-mentioned Figures, a propulsion assembly of a ship or floating platform 1 comprises a hull insert 2, also referred to as a trunk, forming a housing 3, also referred to as a propeller case, located within a hull 4 of a ship or platform.

In accordance with an embodiment, said housing 3 is a housing watertight with respect to the hull in all the walls 5 thereof, except for an opening 6 opening externally to the hull 4 of the ship or platform.

Advantageously, said assembly further comprises a motor 7 and a thruster 8, for example a propeller foot.

In accordance with an embodiment, said thruster 8 is suitable to be arranged externally to said hull 4 to generate a propulsion thrust on said ship or floating platform. Said thruster 8 is further retractable within said housing 3 passing through said opening 6.

In accordance with an embodiment, said motor 7 is arranged in said hull 4, but externally to said housing 3, and it is arranged stationary with respect to said hull 4, i.e., so as not to move with respect to the hull even during the withdrawal or retraction movement of said thruster into said housing 3.

In accordance with an embodiment, said assembly 1 further comprises a telescopic driving shaft 9. Advantageously, said telescopic driving shaft 9 is arranged passing through and forming a seal with one of the walls 5 of said housing 3 to operatively connect said motor 7 and said thruster 8 and to transmit the movement from the motor to the thruster for the movement of said thruster 8.

In accordance with an embodiment, said assembly further comprises a submersible movable hatch 10, made in a separate piece and completely disconnectable from said thruster 8 and said housing 3.

In accordance with an embodiment, said hatch movable 10 is suitable to associate externally to said housing 3, passing externally to said hull 4.

In accordance with an embodiment, said movable hatch 10 is suitable to seal and close said opening 6 of said housing 3, forming a watertight closed chamber 11 with respect to the outside of said hull 4.

In accordance with an embodiment, said assembly further comprises a fluid evacuation device 12 for evacuating fluid 13, for example, sea water, which is present within said closed chamber 11 so as to arrange said thruster 8 at least partially in air, when retracted in said housing 3 that is closed by said hatch to form said closed chamber.

In accordance with an embodiment, said housing 3, under operative conditions of the ship or platform, is arranged at least with a part thereof under the free surface W-W of the fluid 13, for example, sea water, on which said hull 4 is floating.

In accordance with an embodiment, said walls 5 of said housing 3 are walls that are integrated in the hull 4, and they avoid the need to implement a hull seat, for example, an interspace, in which said housing 3 and all the structures interlocked to the movement of the thruster are to be inserted.

In accordance with an embodiment, said telescopic driving shaft 9 is received and forms a seal with a portion thereof in one of the walls 5 of said housing 3 to operatively connect said motor 7 and said thruster 8 in a selectively detachable manner, in order to transmit the movement from the motor to the thruster for the movement of said thruster 8 and to allow, in the case of a maintenance, separating the thruster from the motor.

In accordance with an embodiment, said thruster 8 is retractable within said housing 3 passing through said opening 6 so as not to project externally to said hull 4, when it is in a completely retracted position thereof.

In accordance with an embodiment, the fluid evacuation device 12 for evacuating fluid 13 present within said closed chamber 11 is for example at least a ballast/bilge pump connected with said chamber 11.

In accordance with an embodiment, said telescopic driving shaft 9 comprises a shaft axis V-V, for example, arranged vertical, in other terms, substantially transversal to the free water surface W-W. In accordance with an embodiment, said shaft 9 comprises an azimuthal driving shaft 14 and a telescopic power driving shaft 15.

In accordance with an embodiment, said thruster has a thruster axis, or thrust actuating axis P-P, which is adjustable in inclination with respect to said telescopic shaft axis V-V by a predetermined angle A, so as to orient the thrust of the thruster with respect to the hull 4 or other obstacles that are present under the hull.

In accordance with an embodiment, said fluid evacuation device 12 is suitable to the re-imission of fluid into the closed chamber 11, for example, at the end of the maintenance operations.

In accordance with an embodiment, said assembly further comprises an air inputting device 16 for inputting air into the closed chamber 11 when it is emptied of the fluid and to allow a recirculation of air when maintenance personnel is present therein. For example, the air inputting device 16 comprises tubes for the connection of the closed chamber, or propeller case, with the inside of the hull.

In accordance with an embodiment, said assembly further comprises a maintenance access hatch 17 for the watertight opening and closure, of a portion of a wall of said housing 3, allowing accessing the closed chamber 11 by maintenance personnel of the thruster 8.

In accordance with an embodiment, said assembly further comprises suspension chains and/or cables, or hanging cables 18, connectable to said submersible movable hatch 10 for the handling thereof externally to the hull and the coupling thereof to said opening 6.

In accordance with an embodiment, said assembly further comprises passages 31 provided for in at least one of the walls 5, for example, the upper roof, or sky 32, of said housing 3, to insert hanging cables or chains 18, 20 into said housing to hang said submersible movable hatch 10 passing through said housing 3 or to hang said thruster 8 when it is to be disconnected or it is disconnected from said telescopic driving shaft 9.

In accordance with an embodiment, said assembly further comprises pulleys 33, as the only means for handling the hanging cables 18 of said submersible movable hatch 10, as well as for handling the hanging cables 20 of said thruster 8.

In accordance with an embodiment, a guide cross is provided for in said housing 3, to guide said telescopic driving shaft 9 in at least one, or also in at least one length thereof located within said housing 3 and discharging the thrust actions of the thruster 8 onto the hull 4.

In accordance with an embodiment, said assembly further comprises a telescopic driving shaft and thruster connection joint 22 suitable to removably connect the thruster 8 to the telescopic driving shaft 9 to completely separate said thruster from said shaft and immerse said thruster 8 by withdrawing it from said housing 3 into a fluid, for example, sea water, to leave said hull 4 in a floating condition.

In accordance with an embodiment, said assembly further comprises a first watertight protection, or covering closing cuff 23 that is removably connectable to the shaft free end 9, or first joint flange 24.

In accordance with an embodiment, said assembly further comprises a second watertight protection, or covering closing cuff 25 removably connectable to the portion for the connection of the thruster 8 to the shaft, or second joint flange 26.

In accordance with an embodiment, said motor 7 is an electric motor.

In accordance with an embodiment, said assembly further comprises a thruster lifting device 27, for example of the oleo-dynamic type, connected to a support device or support 28 for the handling of a movable portion of the telescopic driving shaft 9 and of the thruster 8 to extend it outside said housing 3, or to retract said thruster 8 into said housing 3.

In accordance with an embodiment, said assembly further comprises guide candles 19 for guiding the movement of said support 28.

In accordance with an embodiment, said hull insert, or trunk 2, is a structure integrated into the structure of the hull 4 that does not need, to define said watertight walls, a separate cell added to an interspace obtained in the hull.

A method for the maintenance of a propulsion assembly of a ship or platform 1 during the floating thereof is described herein below.

Said method, according to a general embodiment method thereof, comprising the steps of:

providing for a hull insert or trunk 2 forming a housing 3, or propeller case, located within a hull 4 of a ship;

providing for said housing 3 to be watertight with respect to the hull 4 in all the walls 5 thereof, except for an opening 6 opening externally to the hull 4 of the ship;

arranging a motor 7 in said hull externally to said housing 3, avoiding the change of the position thereof with respect to the hull 4;

providing for a thruster 8, for example, a propeller foot, which is suitable to be arranged externally to said hull 4 to generate a propulsion thrust on said ship or floating platform;

providing for a telescopic driving shaft 9 passing through and forming a seal with one of the walls 5 of said housing, operatively connecting said motor 7 and, in a preferably but not necessarily removable manner, said thruster 8, to transmit the movement from the motor to the thruster for the movement of said thruster.

Said method provides for the further steps of:

retracting said thruster 8 within said housing 3 passing through said opening 6, preferably, but not necessarily, preventing it from projecting externally to said hull;

lowering a submersible movable hatch 10 externally to the hull in a separate piece and completely disconnected from said thruster 8 and said housing 3;

associating said submersible movable hatch 10 externally to said housing 3 and sealing and closing said opening 6 of said housing, closing said housing and forming a watertight closed chamber 11 with respect to the outside of said hull containing said thruster;

evacuating any fluids, for example, sea water 13, which are present within said housing even when the hull or platform is floating and partially submersed, when it is closed by said submersible movable hatch 19, so as to arrange said thruster 8 at least partially in air.

In accordance with a possible further method, the following steps are optionally further provided for, of accessing through a maintenance access hatch 17 said chamber 11 in said housing 3 for the maintenance of the thruster 8.

In accordance with a possible further method, said maintenance step comprises the step of replacing propeller seals 29.

In accordance with a possible further method, said maintenance step comprises the steps of:

disassembling seals protection rings 30 replacing worn propeller seals 29 with new propeller seals 29 evacuating personnel from said chamber 11 of said housing 3 making it to be lifted through said maintenance access hatch 17 to the upper decks sealing closing said housing access hatch 17 flooding said chamber 11 removing the submersible movable hatch 10 from externally to the hull bringing said submersible movable hatch 10 back to the surface by passing externally to the ship.

In accordance with a possible further method, said housing 3 under operative conditions is arranged at least partially under the free water surface W-W.

In accordance with a possible further method, said maintenance step further comprises the step of:

Disassembling, when the ship or platform is floating, of the entire thruster or propeller foot 8 and withdrawing it from the hull to bring it back to the surface by passing externally to the floating ship or platform.

In accordance with a possible further method, said maintenance step comprises the steps of:

installing the submersible movable hatch 10 in the proximity of the opening 6 of the housing 3 of the hull insert, or trunk 2, by hanging cables 18, and by means of the optional aid of diving personnel pumping for evacuating the residual water from the chamber, or propeller case 11, by a fluid evacuation device, for example, but not necessarily, ballast/bilge pumps of the ship 12 when the case 11 is emptied, allowing personnel access said case, lifting the propeller foot 8 with the aid of said hanging cables uncoupling the joint 22 by disconnecting the first flange 24 and the second flange 26 of the joint for the connection of the telescopic driving shaft 9 to the thruster, or propeller foot 8 lowering the entire propeller foot 8 to allow securing protection cuffs 23, 25 at the free ends of the shafts and the thruster;

evacuating personnel from the propeller case 11, and sealing and closing said housing access hatch 17 flooding said chamber 11 removing the submersible movable hatch 10 from externally to the hull bringing said submersible movable hatch 10 and said propeller foot 8 back to the surface by passing externally to the hull.

In accordance with a possible further method, said maintenance step comprises the steps of:

hanging said submersible movable hatch externally to the hull by suspension chains and cables or hanging cables 18.

In accordance with a possible further method, said maintenance step comprises the steps of:

hanging said thruster or propeller foot 8 by hanging cables or chains 20 passing through said housing 3.

In accordance with a possible further method, said maintenance step comprises the steps of:

inserting into said housing, through closable passages 31 provided for through the walls 5 of said housing 3, hanging cables or chains 18, 2.0 to hang said submersible movable hatch 10 passing through said housing or to hang said thruster 8 also disconnecting it from said telescopic driving shaft 9.

In accordance with a possible further method, said maintenance step comprises the steps of:

inclining by a predetermined angle A the thruster axis, or thrust actuating axis P-P, with respect to the telescopic shaft axis V-V so as to orient the thrust of the thruster with respect to the hull 4 or other obstacles.

In accordance with a possible further method, said maintenance step comprises the steps of:

guiding said telescopic driving shaft 9 in at least a length thereof located within said housing by a guide cross 21.

In accordance with a possible further method, said maintenance step comprises the steps of:

discharging onto the hull the thrust actions of the thruster by said guide cross 21.

In accordance with a possible further method, said maintenance step comprises the steps of:

Installing the submersible movable hatch 10 in the proximity of the opening 6 of the housing 3 of the hull insert or trunk 2 by hanging cables 18, and optionally by the aid of diving personnel.

In accordance with a possible further method, said maintenance step comprises the steps of:

bringing said submersible movable hatch 10 and said propeller foot 8 back to the surface by passing externally to the ship.

It shall be apparent that those skilled in the art, with the aim of meeting contingent, specific needs, will be able to make a number of modifications and variations to the assembly according to the invention, all of which anyhow falling within the protection scope of the invention, as defined by the following claims.

REFERENCES

1 propulsion assembly
2 hull insert
3 housing or propeller case
4 ship hull
5 housing walls
6 housing opening
7 motor
8 thruster
9 telescopic driving shaft
10 submersible movable hatch
11 closed chamber within housing
12 fluid evacuation device from the chamber
13 fluid—sea water
14 azimuthal driving shaft
15 power driving shaft
16 air inputting device
17 maintenance access hatch
18 chains or hanging cables for submersible movable hatch
19 guide candles
20 suspension chains or hanging cables of thruster
21 guide cross
22 thruster shaft connection joint
23 first watertight protection or covering closure cuff
24 first shaft side joint flange
25 second watertight protection or covering closure cuff
26 second thruster side joint flange
27 thruster lifting device
28 support device handling shaft and propeller foot
29 propeller seals
30 propeller seals protection
31 passages for chains or cables in housing walls
32 housing or chamber upper roof, sky
33 pulleys for handling hanging cables
34 edge of hull insert defining the opening for the coupling to the hatch
V-V shaft axis
P-P thrust actuating axis, for example, thruster axis or propeller axis
W-W free water surface
A angle between V-V and P-P

The invention claimed is:

1. A ship or floating platform propulsion assembly, comprising a hull insert, or trunk, forming a housing, or propeller case, located within a hull of a ship or platform;

said housing being watertight with respect to the hull in all walls thereof, except for an opening externally to the hull of the ship or platform;

a motor;

said motor being arranged in said hull, but externally to said housing, and being arranged stationary with respect to said hull;

a thruster arranged externally to said hull to generate a propulsion thrust on said ship or floating platform;

a telescopic driving shaft passing through and forming a seal with one of the walls of said housing to operatively connect said motor and said thruster and to transmit movement from the motor to the thruster for the movement of said thruster;

said thruster being retractable within said housing passing through said opening;

a submersible movable hatch in a separate piece and completely disconnectable from said thruster and said housing;

said movable hatch passing externally to said hull, and sealing and closing said opening of said housing, closing said housing and forming a watertight closed chamber;

a fluid evacuation device for evacuating fluid, which is present within said closed chamber, so as to arrange said thruster, when retracted in said housing closed by said hatch to form said closed chamber, at least partially in air.

2. The assembly according to claim 1, wherein said housing, in operative conditions, is arranged at least with a part thereof under a free surface of the fluid, for example, sea water, on which said hull is floating;

wherein said walls of said housing are walls integrated in the hull, avoiding the use of a hull seat into which said housing is to be inserted;

wherein said telescopic driving shaft is passing and watertight through one of the walls of said housing to operatively connect said motor and, in a selectively detachable manner, said thruster and to transmit the movement from the motor to the thruster for the movement of said thruster;

wherein said thruster is retractable within said housing passing through said opening so as not to project externally to said hull, when said thruster is in a completely retracted position thereof;

wherein a fluid evacuation device for evacuating fluid present within said closed chamber comprises a ballast/bilge pump connected with said chamber for evacuating fluid present in said chamber even when the hull or platform is submersed, when said chamber is closed by said submersible movable hatch, so as to arrange said thruster, when retracted in said housing and closed by said hatch to form said closed chamber, at least partially in air.

3. The assembly according to claim 1, wherein said telescopic driving shaft comprises a shaft axis, for example, arranged vertical substantially transversely to the free water surface; and wherein said shaft comprises an azimuthal driving shaft and a telescopic power driving shaft; wherein said thruster has a thruster axis, or thrust actuating axis, which is adjustable in inclination with respect to said telescopic shaft axis by a predetermined angle so as to orient thrust of the thruster with respect to the hull or other obstacles present under the hull.

4. The assembly according to claim 1, wherein said fluid evacuation device is suitable to reintroduction of fluid into the closed chamber, for example, at the end of the maintenance operations;

wherein said assembly further comprises an air pumping device for introducing air into the closed chamber, for example, tubes for the connection of the closed chamber, or propeller case, with the inside of the hull.

5. The assembly according to claim 1, wherein a maintenance access hatch is configured for watertight opening and closing a portion of the wall of the housing for accessing the closed chamber by maintenance personnel.

6. The assembly according to claim 1, wherein further comprising suspension chains and/or cables, or hanging cables configured for being connected to said submersible movable hatch for the handling thereof outside the hull and the coupling thereof to said opening;

wherein said assembly further comprises passages provided in at least one of the walls of said housing to insert the hanging cables or chains in said housing to hang the submersible movable hatch passing through said housing or to hang said thruster when said thruster is disconnected from said telescopic driving shaft;

wherein said assembly further comprises pulleys, as the only means for handling both the hanging cables of said submersible movable hatch and the hanging cables of said thruster.

7. The assembly according to claim 1, wherein a guide cross is provided in said housing, to guide said telescopic driving shaft in at least a length thereof located within said housing and to discharge onto the hull thrust actions of the thruster.

8. The assembly according to claim 1, further comprising a telescopic driving shaft and thruster connection joint which is suitable to removably connect the thruster to the telescopic driving shaft; and wherein a first watertight protection or covering closure cuff is provided, which is removably connectable to a shaft free end, or first joint flange, and a second watertight protection or covering closure cuff removably connectable to a portion for connection to the thruster shaft, or second joint flange to completely separate said thruster from said shaft and to submerse said thruster by withdrawing said thruster from said housing in a fluid.

9. The assembly according to claim 1, wherein said motor is an electric motor;

wherein said assembly further comprises a thruster lifting device connected to a support device for handling a movable portion of the telescopic driving shaft and of the thruster to extend the telescopic driving shaft outside said housing or to retract said thruster into said housing;

further comprising guide candles for guiding the movement of said support device.

10. The assembly according to claim 1, wherein said hull insert, or trunk, is a structure integrated in the hull.

* * * * *